US007235040B2

(12) United States Patent
Chung-Ting

(10) Patent No.: US 7,235,040 B2
(45) Date of Patent: Jun. 26, 2007

(54) WEIGHT STACK FITNESS EXERCISE UNIT

(76) Inventor: Tseng Chung-Ting, P.O. Box 24-108, Taipei (TW)

( * ) Notice: Subject to any disclaimer, the term of this patent is extended or adjusted under 35 U.S.C. 154(b) by 569 days.

(21) Appl. No.: 10/263,239

(22) Filed: Oct. 3, 2002

(65) Prior Publication Data

US 2004/0067824 A1 Apr. 8, 2004

(51) Int. Cl.
*A63B 21/06* (2006.01)

(52) U.S. Cl. ..... 482/93; 482/94; 482/142; 482/140; 482/148

(58) Field of Classification Search ..... 482/93–96, 482/136, 139, 142, 908, 148; D21/662, 665, D21/676, 686, 690
See application file for complete search history.

(56) References Cited

U.S. PATENT DOCUMENTS 4,568,079 A * 2/1986 Stark ..... 472/14
RE32,150 E * 5/1986 Rice ..... 482/110
5,498,222 A * 3/1996 Hur ..... 482/112
6,248,048 B1 * 6/2001 Zuckerman et al. ..... 482/142
6,485,398 B1 * 11/2002 Kreft ..... 482/94
2003/0087737 A1 * 5/2003 Studdard
2003/0130100 A1 * 7/2003 Perez ..... 482/140
2004/0152572 A1 * 8/2004 Reitz et al.

* cited by examiner

*Primary Examiner*—Lori Amerson
(74) *Attorney, Agent, or Firm*—Troxell Law Office, PLLC

(57) ABSTRACT

A weight stack exercise unit particularly for working on one's waist, abdomen and legs comprised of a frame that can be folded up for storage or shipment and expanded holding onto ground to support the unit; a handlebar each being provided on both sides and a lever laterally provided in the center of the frame; the lever pivoted to a rotary turntable; a circular track formed on the turntable to engage with a pulley beneath the seat; a lateral bar extending from front of the seat; a foot support each provided to the utmost front of the lateral bar; two weighted sections on both sides of the handlebar; the user sitting or lying on the seat to hold the handlebar with feet in both foot supports applying force to cause the lateral bar and the seat to swivel up and down, or to swivel laterally by releasing the seat for it to slide along a circular track on turntable and by changing loads of the weights depending on the individual user and the length of the training session.

4 Claims, 5 Drawing Sheets

WEIGHT STACK FITNESS EXERCISE UNIT

BACKGROUND OF THE INVENTION (a) Field of the Invention

The present invention is related to a fitness exercise unit, and more particularly to one that works on one's waist, abdomen and legs.

(b) Description of the Prior Art

Whereas people today are more conscious of fitness thanks to the ever-improved living standard, fitness equipment has become very popular. However, some of the fitness equipment emphasizing sit up in bear hands may get too rough and violent resulting in stretch in larger angles that causes injuries to the user having overweighed problem or in middle ages or elder. Furthermore, the sit up may become so monotonous and the user may be disinterested very quickly. Besides, fitness equipment generally available in the market either consumes too much space at home or is very expensive, plus other factors, such as the users in a family whose age, physical strength vary, the confined space available at home, the limit to only one function, and nature and length of training session. All these may well frustrate the consumer for a buy. Therefore, a fitness equipment that allows fast and easy adjustment to suit needs by individual user, keeps the users highly motivated for a work-out in long term, and helps significant reduction of space is required.

SUMMARY OF THE INVENTION

The primary purpose of the present invention is to provide a weight stack exercise unit. The stack is foldable for storage and extends to hold onto the floor in use. A handlebar is respectively provided on the left and the right of the stack and a support bar is laterally provided and pivoted to a rotary turntable. A track is formed on the turntable and the turntable can be mutually incorporated into a seat provided at its bottom a pulley. A lateral bar extends from the front end of the seat. A foot support is adapted to the utmost front of the lateral bar and one weighted section each is provided to both sides of the lateral bar so that the user may sit and lie down on the seat with both hands holding the handlebar and both feet secured by the foot support to apply force and release, thus to cause the lateral bar and the seat to engage in reciprocal swivel up and down for working on one's waist, abdomen and legs.

Another purpose of the present invention is to provide a weight stack exercise unit that is particularly adapted to different users or long-time training of variety by an easy and fast change of the weight load on both sides of the lateral bar and the swivel seat.

To achieve the purposes, the weight stack exercise unit particularly for working on one's waist, abdomen and legs comprised of a frame that can be folded up for storage or shipment and expanded holding onto ground to support the unit; a handlebar each being provided on both sides and a lever laterally provided in the center of the frame; the lever pivoted to a rotary turntable; a circular track formed on the turntable to engage with a pulley beneath the seat; a lateral bar extending from front of the seat; a foot support each provided to the utmost front of the lateral bar; two weighted sections on both sides of the handlebar; the user sitting or lying on the seat to hold the handlebar with feet in both foot supports applying force to cause the lateral bar and the seat to swivel up and down, or to swivel laterally by releasing the seat for it to slide along a circular track on turntable and by changing loads of the weights depending on the individual user and the length of the training session.

DETAILED DESCRIPTION OF THE PREFERRED EMBODIMENTS

Figure 1:
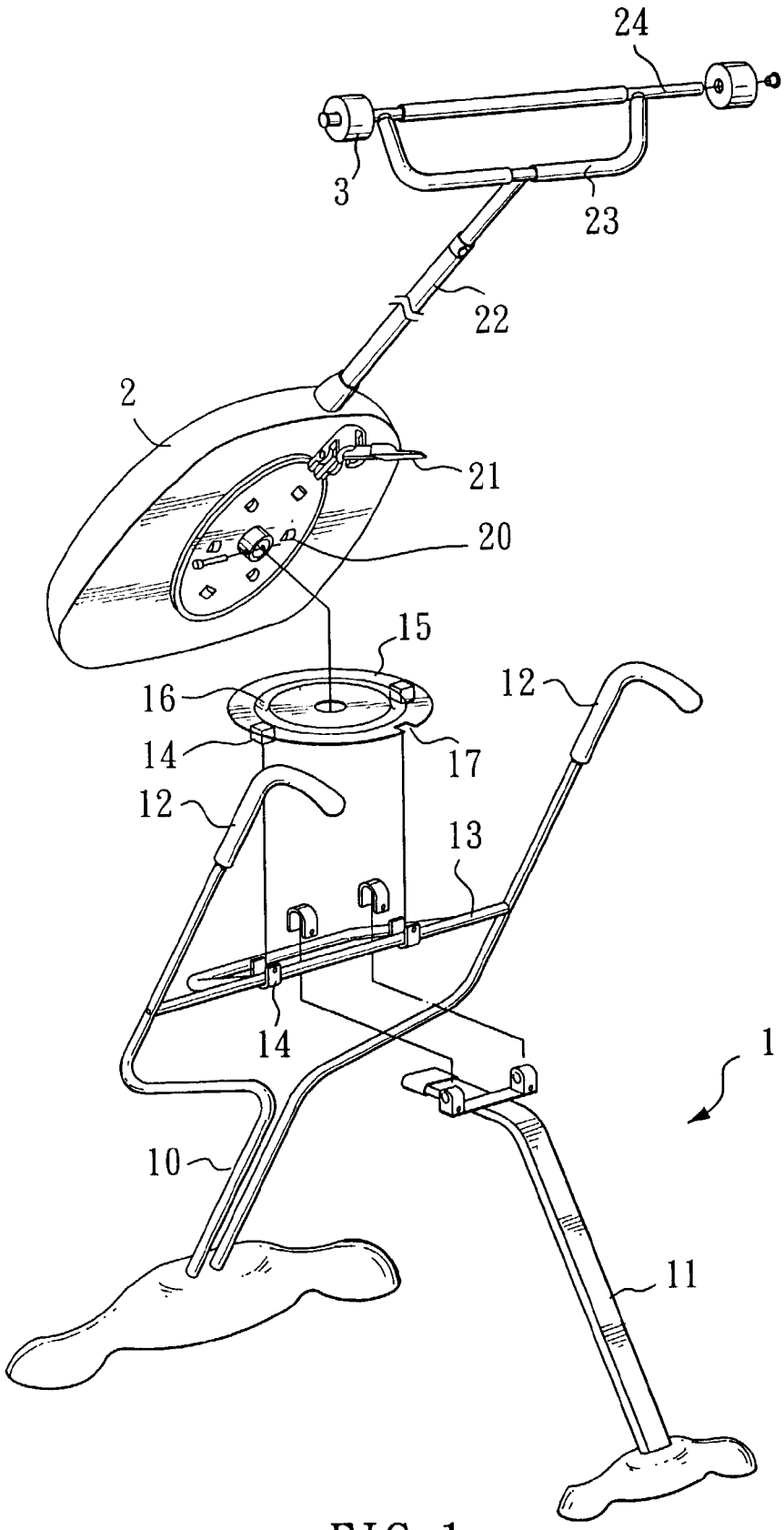
FIG. 1 is an exploded view of a preferred embodiment of the present invention.
Figure 2:
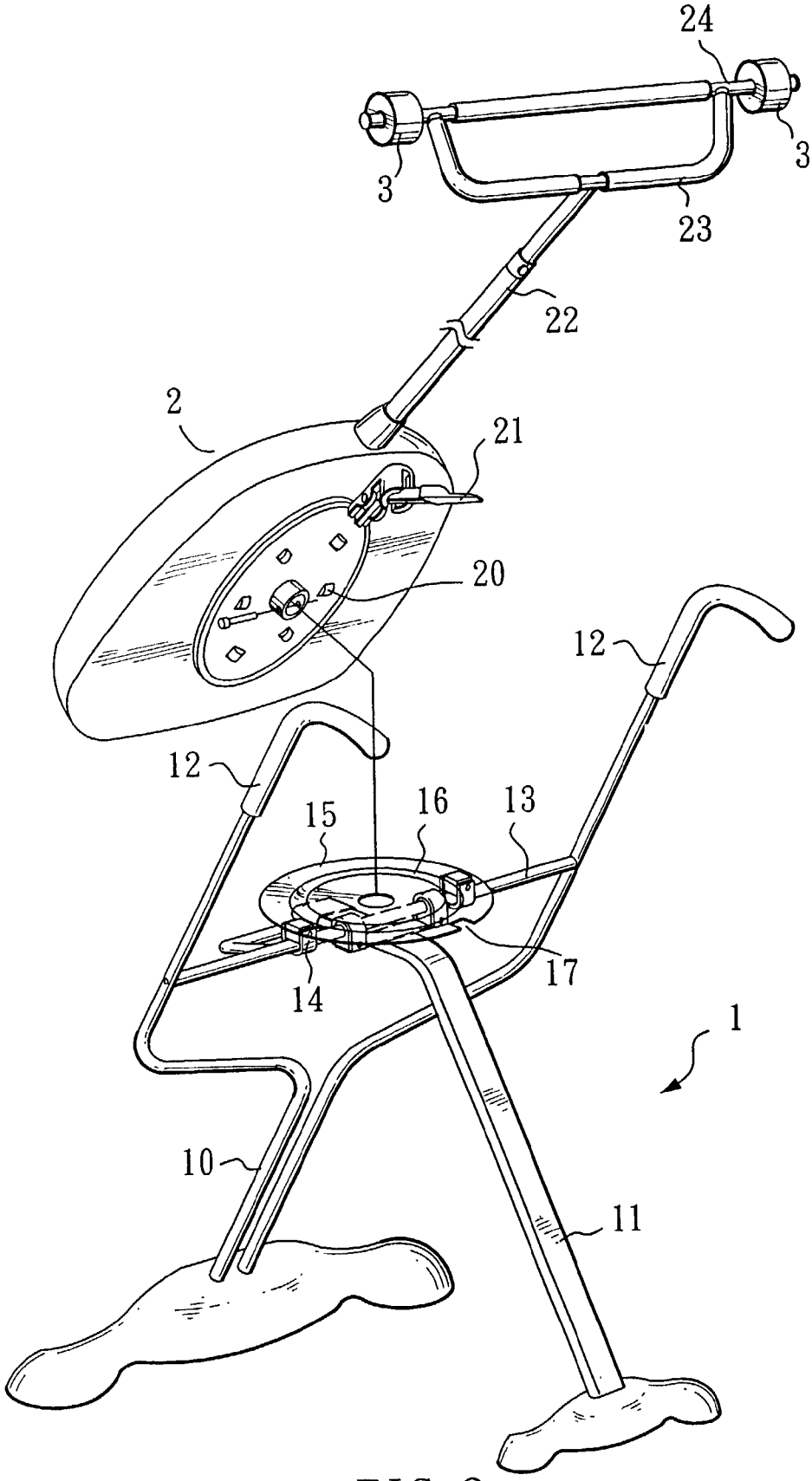
FIG. 2 is an exploded view showing assembly and fixation of the preferred embodiment of the present invention.
Figure 3:
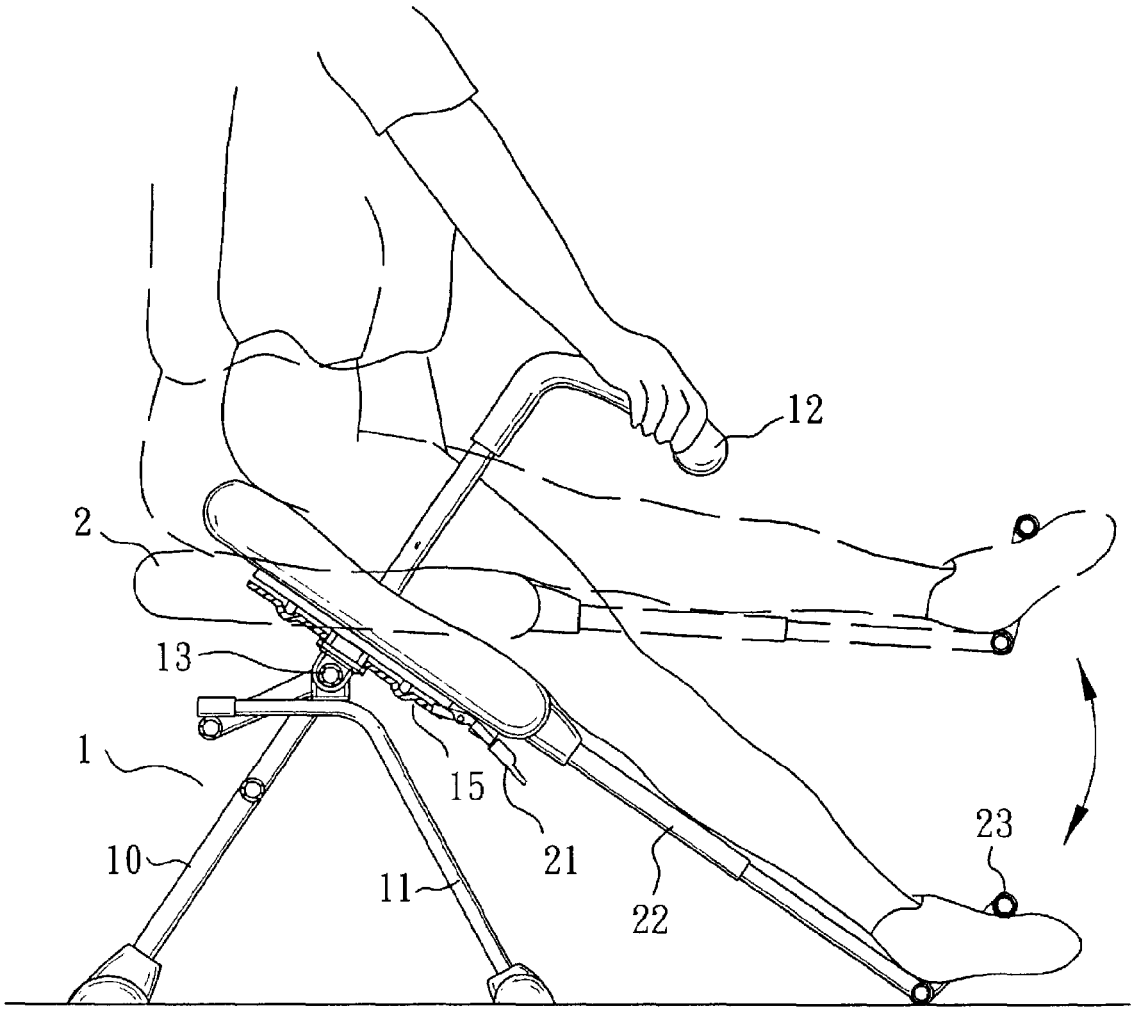
FIG. 3 is a side view of the preferred embodiment of the present invention.
Figure 4:
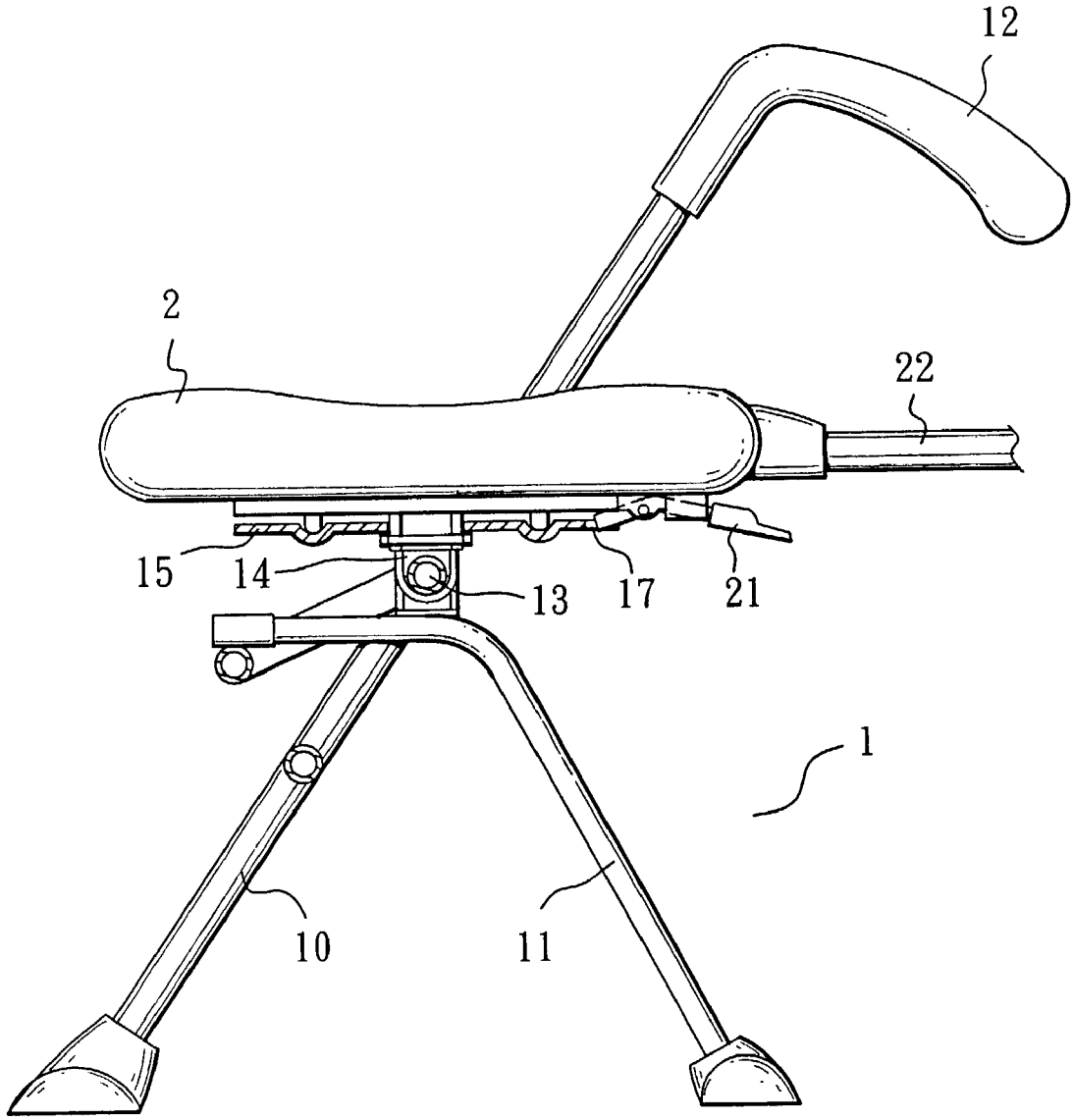
FIG. 4 is a side view of the preferred embodiment of the present invention as assembled.
Figure 5:
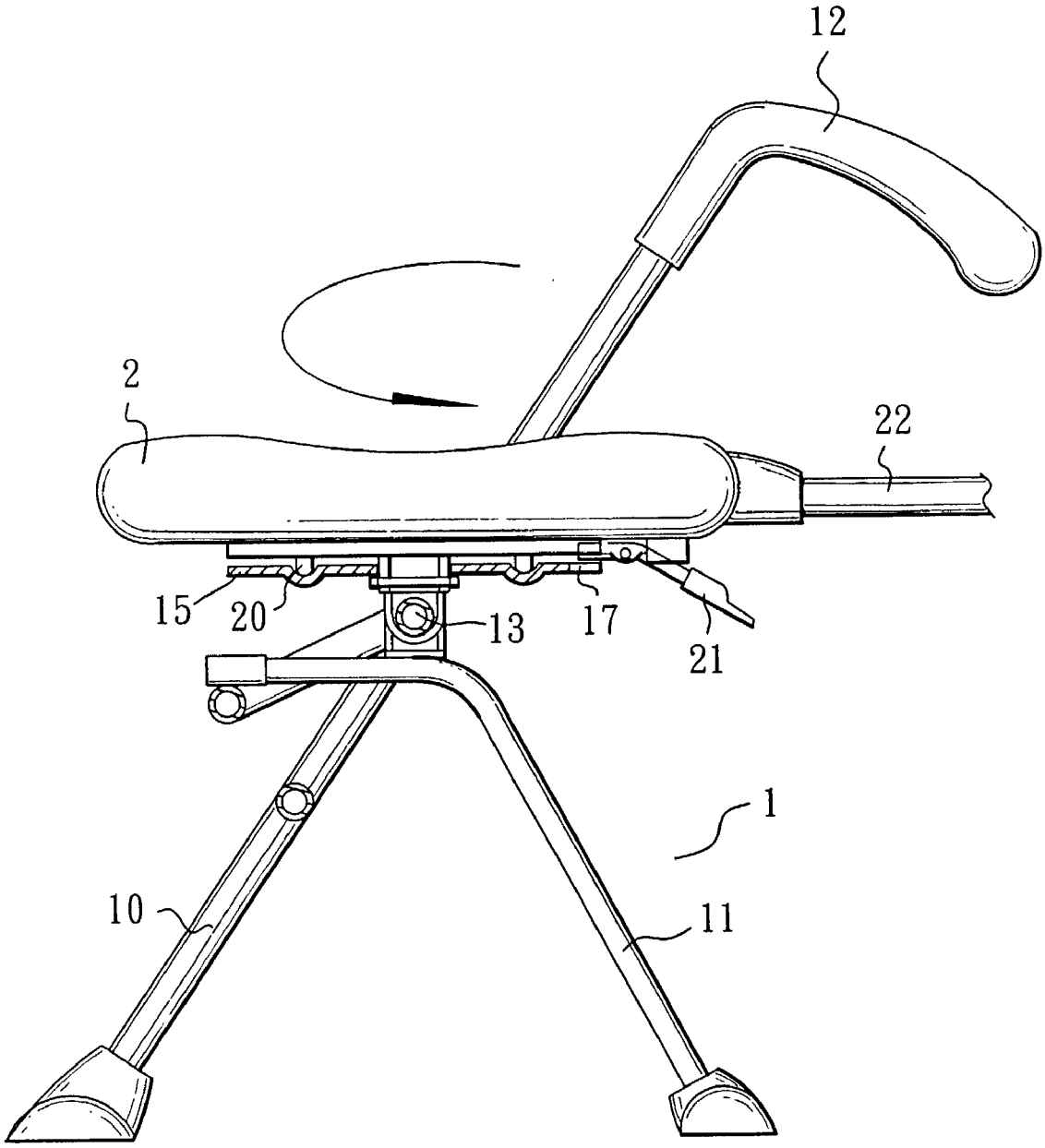
FIG. 5 is a side view showing a swivel seat of the preferred embodiment of the present invention.

Referring to FIGS. 1 through 5 of the accompanying drawings, a preferred embodiment of the present invention is essentially comprised of a foldable frame (1), a seat (2) and two weights (3). Wherein, the foldable frame (1) includes two pipes (10) having at their lower ends welded to each other are mutually pivoted to a rod (11) to support the seat (2) on the ground. There are many ways ranging from summary one to extremely sophisticate one available for pivoting the pipes (10) to the rod (11) well known to those who are familiar with the art and will not be repeated here. The upper end of each of the pipes (10) is connected with a handlebar (12). Said handlebar (12) may be provided in any form that is allows adjustment and exchangeable with other similar structure. The seat (2) permits its user to sit or lie down upon it. A lever (13) with two pivots (14) is laterally provided between the two pipes (11) and pivoted to a turntable (15). The turntable (15) is engaged with its circular track (16) to a pulley (20) attached to where beneath the seat (2). The pulley (20) resting in the circular track (16) slides along the track (16). A stopper (21) provided to the frame (1) can be locked up to or released from an insertion hole (17) provided on the circumference of the turntable (15). A retractable lateral bar (22) extending forwardly from the front of the seat (2) is provided at its utmost front a foot support (23), and a weighted section (24) each at both sides to allow insertion of weight (3) of different loads as desired.

When assembled, both of the pipes (10) and the rod (11) of the folded frame (1) are fully expanded to hold firmly against the ground. The seat (2) is inserted into the turntable (15) and secured with a fixation pin to prevent the seat (2) from falling out of the turntable (15). This permits easy and fast assembly. When the exercise unit is not in use for storage or shipment, the seat (2), the turntable (15) and the frame (1) are removed in reserve sequence to reduce space consumption. In use, the length of the retractable lateral bar (22) of the seat is adjusted and secured depending on the height of the individual user. The user then either sits on or lie on the seat with both feet held by the foot supports (23) and both hands gripping on the handlebar (12) of the frame (1) to exert force with both feet to lift up the lateral bar (22) and the seat (2) for upward swivel; and when no force is applied by both feet of the user, both of the lateral bar (22) and the seat (2) swivel downward as taken for granted to create reciprocal swivel up and down to work on waist, abdomen and legs of the user. To create lateral swivel or simply stay in stationary status, the pulley (20) attached to the seat (2) slides along the circular track (16) on the turntable (15) by fast adjusting the weights (3) secured to both weighted sections (24) of the lateral bar (22) and by releasing the stopper (21) of the seat (2) for the seat (2) to clear away from the fixation hole (17) in the turntable (15). Depending on the individual user, or the length of the training session, the operation of the exercise unit can be changed to offer more options.

Although a particular embodiment of the invention has been described in detail for purpose of illustration, various modifications and enhancements may be made without departing from the spirit and scope of the invention. Accordingly, the invention is not to be limited except as by the appended claims.

The invention claimed is:

1. A weight stack exercise unit for working a waist, abdomen and legs of a user comprising:

a) a frame having a pipe and a rod pivotally connected to the pipe for supporting the exercise unit; and b) a seat having:

i) two handle bars located on opposing sides of the frame;

ii) a lever located on a center of the frame and pivotally connected to a turntable to allow the seat to pivot downwards and upwards, the turntable being connected to a bottom surface of the seat, the turntable being configured to selectively swivel laterally;

iii) a retractable lateral bar extending forwardly from a front of the seat;

iv) a foot support extending from a front of the lateral bar; and v) weights located on a weighted section located on opposing ends of the foot support, the weights having a predetermined weight.

2. The weight stack exercise unit according to claim 1, wherein the turntable has a circular track, the seat has a pulley located beneath the seat and a stopper, the pulley engaging the circular track, the stopper being movable between fixed and released positions in an insertion hole provided in the turntable of the seat.

3. The weight stack exercise unit according to claim 1, wherein the pipe and rod are movable between folded and expanded positions for storage and use respectively.

4. The weight stack exercise unit according to claim 1, wherein the handlebar of the frame is adjustable and exchangeable with other handles.

* * * * *